US009353644B2

(12) United States Patent
LeBlanc et al.

(10) Patent No.: US 9,353,644 B2
(45) Date of Patent: May 31, 2016

(54) SYNCHRONIZING RING SURGE BUMPER

(75) Inventors: Ryan Edward LeBlanc, Glastonbury, CT (US); Patrick G. Richards, Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 817 days.

(21) Appl. No.: 13/586,206

(22) Filed: Aug. 15, 2012

(65) Prior Publication Data

US 2014/0050567 A1 Feb. 20, 2014

(51) Int. Cl.
*F01D 17/16* (2006.01)

(52) U.S. Cl.
CPC ..... *F01D 17/162* (2013.01); *Y10T 74/20636* (2015.01)

(58) Field of Classification Search
CPC ..... F01D 17/16; F01D 17/162; F01D 25/24; F01D 25/234; F01D 25/28; F01D 25/246; F01D 9/04; F04D 29/563
See application file for complete search history.

(56) References Cited

U.S. PATENT DOCUMENTS

| | | | | |
|---|---|---|---|---|
| 3,736,070 | A * | 5/1973 | Moskowitz et al. | 415/147 |
| 6,884,025 | B2 | 4/2005 | Pickens et al. | |
| 8,092,157 | B2 | 1/2012 | McCaffrey | |
| 8,123,472 | B2 | 2/2012 | Redgwell | |
| 2003/0188497 | A1 * | 10/2003 | Price | E02D 27/01 52/169.12 |
| 2009/0038739 | A1 | 2/2009 | Holland et al. | |
| 2009/0162192 | A1 | 6/2009 | McCaffrey | |
| 2012/0043171 | A1 * | 2/2012 | Sella et al. | 188/379 |
| 2012/0195751 | A1 | 8/2012 | Gasmen et al. | |
| 2012/0195755 | A1 * | 8/2012 | Gasmen et al. | 415/230 |

OTHER PUBLICATIONS

Steven Engineering (https://stevenengineering.com/tech_support/PDFs/83FP-LINEAR.pdf—retrieved Dec. 9, 2015—Available Online since Oct. 16, 2011 as per Internet Achive Wayback Machine).*

International Search Report and Written Opinion, dated Nov. 12, 2013, for PCT Application No. PCT/US2013/053779, 11 pages.

* cited by examiner

*Primary Examiner* — Christopher Verdier
*Assistant Examiner* — Juan G Flores
(74) *Attorney, Agent, or Firm* — Kinney & Lange, P.A.

(57) ABSTRACT

A bumper assembly includes a bracket and a pad. The pad is connected to the bracket by a first rivet. Additionally, a synchronizing ring assembly for a gas turbine engine includes a ring section and a bumper assembly. The bumper assembly is connected to a side surface of the ring section and extends axially adjacent an inner radial surface of the ring. The bumper assembly is disposed adjacent a gap at an end of the ring section.

18 Claims, 6 Drawing Sheets

SYNCHRONIZING RING SURGE BUMPER

BACKGROUND

The present invention is related to gas turbine engines, and in particular to a system for positioning variable guide vanes.

Gas turbine engines rely on rotating and stationary components to effectively and efficiently control the flow of air through the engine. Rotating components include rotor blades employed in compressor and turbine sections for compressing air and extracting energy from air after combustion. Stationary components include vanes placed in the airflow to aid in directing airflow. By varying the position of the vanes (i.e., rotating them to vary the profile provided to the airflow), airflow characteristics can be optimized for various operating conditions.

One system for providing actuation of the vanes is a linear actuator connected to the plurality of variable guide vanes via a series of linkages and synchronizing rings. Splice brackets are used to bridge the halves of the synchronizing ring together. Excess deflections of the linkages and/or synchronizing rings will affect system's ability to control the position of the variable vanes accurately. Specifically, deflection of the synchronizing ring causes variation of the vane positions around the vane stage. Typically, adjustable composite bumpers mounted on the inner diameter of the synchronizing ring (along with high synchronizing ring stiffness) are used to limit the radial deflection of the synchronizing ring during normal engine operation conditions. However, under some engine conditions such as engine surge condition, much higher loads can cause excessive deflections of the synchronizing ring. These deflections can result in stresses exceeding the yield strength of the synchronizing ring and adjoining splice brackets. These deflections cannot be accommodated by typical composite bumper designs within the constrained space of some gas turbine engines.

SUMMARY

A bumper assembly includes a bracket and a pad. The pad is connected to the bracket by a first rivet.

A synchronizing ring assembly for a gas turbine engine includes a ring section and a bumper assembly. The bumper assembly is connected to a side surface of the ring section and extends axially adjacent an inner radial surface of the ring. The bumper assembly is disposed adjacent a gap at an end of the ring section.

A gas turbine engine includes an engine case, a compressor and/or turbine section with a first stage of variable guide vanes, a synchronizing ring assembly, and a surge bumper assembly. The synchronizing ring assembly is disposed about the engine case and is connected to the first stage of variable guide vanes. The surge bumper assembly is connected to a first side surface of the synchronizing ring assembly. The surge bumper assembly extends axially adjacent an inner radial surface of the synchronizing ring assembly and is configured to contact the engine case during select engine operating conditions.

DETAILED DESCRIPTION

The present application discloses a surge bumper assembly that is part of a synchronizing ring assembly for a gas turbine engine. The surge bumper assembly includes a bracket that is riveted or otherwise connected to the synchronizing ring adjacent a split in the synchronizing ring. A composite pad is riveted or otherwise connected to the bracket so as to be disposed between the bracket and a case of the gas turbine engine.

A gas turbine engine generally includes an engine case, a compressor and turbine section. A typical compressor has multiple variable guide vanes, synchronizing ring assemblies with adjustable bumpers. These can be used in either or both the high pressure compressor (HPC) as well as the low pressure compressor (LPC) sections of the gas turbine engine. The gas turbine engine illustrated in this application illustrates variable guide vanes, synchronizing ring assembly with adjustable bumper assemblies, and a surge bumper assembly used in the HPC by way of example. It should be understood that the variable guide vanes, synchronizing ring assembly with adjustable bumper assemblies, and a surge bumper assembly can alternatively or additionally be used in the LPC section of the gas turbine engine as well.

During certain operation conditions (e.g., surge), the surge bumper assembly minimizes excessive radial deflection (chording) of the synchronizing ring assembly. This allows the synchronizing ring assembly to achieve more precise alignment and positioning of variable vanes as well as reducing stresses on the synchronizing ring assembly. The compact design of the surge bumper assembly allows it to be disposed in locations where other conventional bumpers are unable to fit. Additionally, the surge bumper assembly provides for a simplified easily installable design relative to conventional bumpers.

Figure 1:
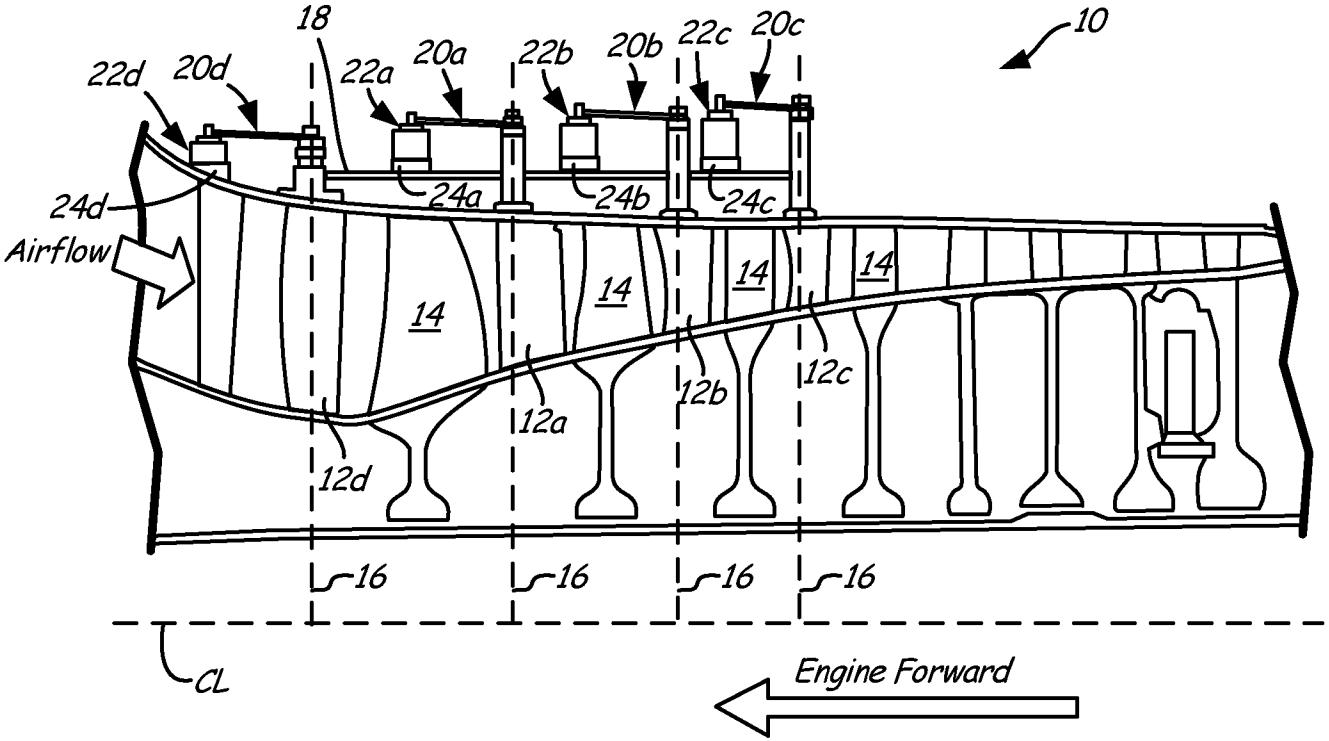
FIG. 1 is a cross-sectional view of a gas turbine engine according to an embodiment of the present invention.

FIG. 1 is a cross-sectional view of a compressor section of a gas turbine engine 10 that includes a plurality of rotatable variable guide vanes (VGV) 12*a*-12*d*, a plurality of rotor blades 14, an engine case 18, vane arms 20*a*-20*d*, synchronizing ring assemblies 22*a*-22*d*, and bumpers 24*a*-24*d*. Although FIG. 1 references the compressor section principles of the present invention may be applied to a turbine section of a gas turbine engine as well.

In the embodiment shown in FIG. 1, VGVs 12*a*-12*d* comprise stages 1-3 VGVs 12*a*-12*c* and inlet guide vane (IGV) 12*d*. With respect to VGVs 12*a*-12*c*, each is rotatable about an axis 16 that is substantially perpendicular with engine centerline axis $C_L$. With respect to IGV 12*d*, IGV 12*d* is rotatable about an axis 16. The performance of gas turbine engine 10 is modified, in part, by adjusting the position of stationary VGVs 12*a*-12*d* to selectively vary airflow characteristics of the engine.

The mechanical force used to change the position of VGVs 12*a*-12*d* is provided by an actuator (not shown), and is communicated via an assembly of linkages (not shown) to VGVs 12*a*-12*d* via synchronizing ring assemblies 22*a*-22*d* and vane arms 20*a*-20*d*.

The actuator and linkages (not shown) are positioned radially outward of engine case 18. Synchronizing ring assemblies 22*a*-22*d* are disposed around the engine case 18 and are mounted on bumpers 24*a*-24*d*. Thus, bumpers 24A-24*d* are disposed at various locations around the inner circumference of synchronizing ring assemblies 22*a*-22*d* between synchronizing ring assemblies 22*a*-22*d* and engine case 18.

Linkages (not shown) are connected to synchronizing ring assemblies 22*a*-22*d*. During operation, linkages are actuated to move synchronizing ring assemblies 22*a*-22*d* and cause them to slide relative to engine case 18 on bumpers 24*a*-24*d*. Vane arms 20*a*-20*d* are mounted to synchronizing ring assemblies 22*a*-22*d* and extend to connect to trunnion portions of VGVs 12*a*-12*d* that protrude from engine case 18. Circumferential and translational movement of the synchronizing ring assemblies 22*a*-22*d* relative to engine case 18 causes vane arms 20*a*-20*d* to move thereby causing VGVs 12*a*-12*d* to pivot about axes 16.

Figure 2:
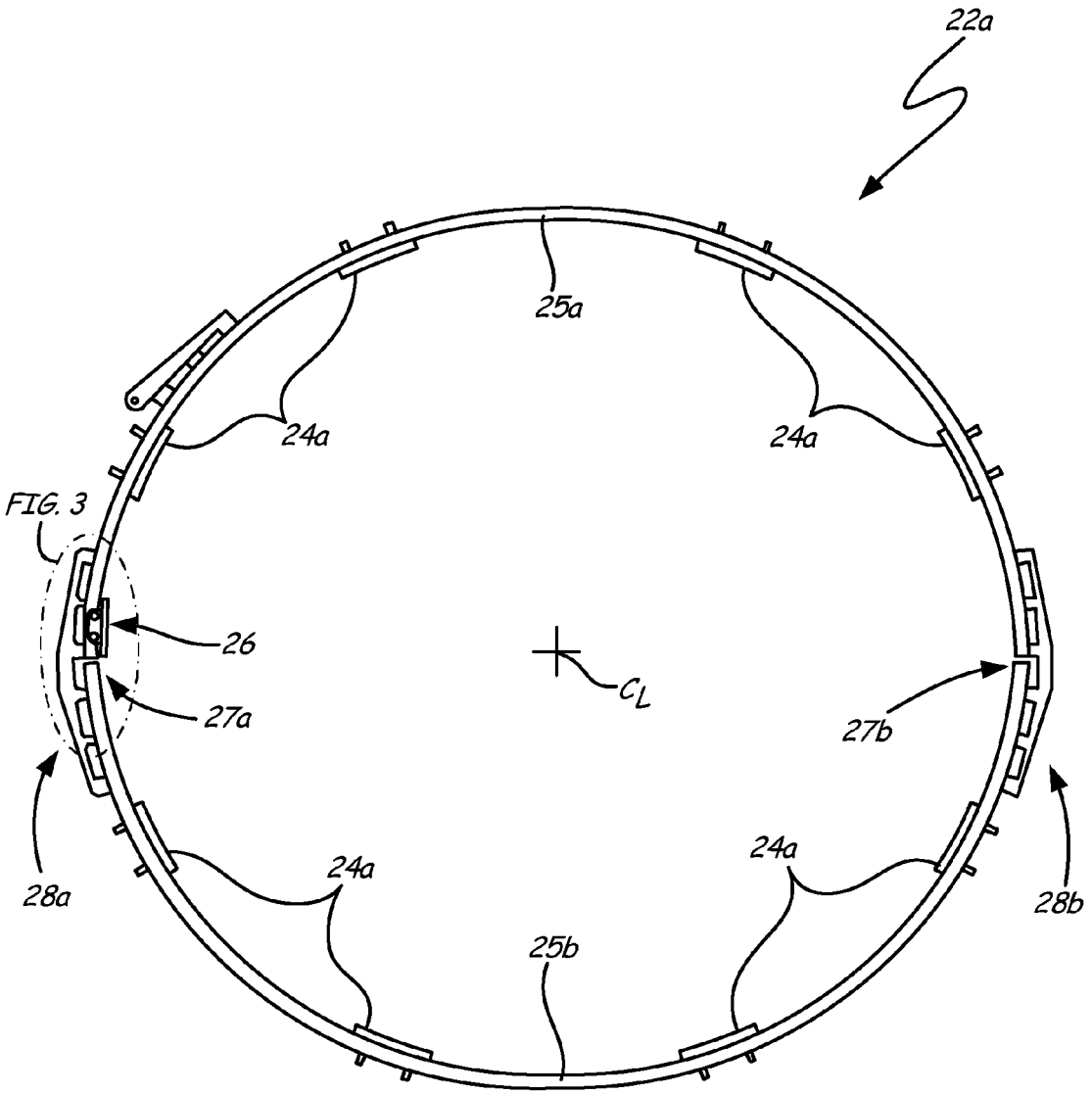
FIG. 2 is an aft view of one embodiment of a synchronizing ring with bumpers including a surge bumper assembly.
Figure 3:
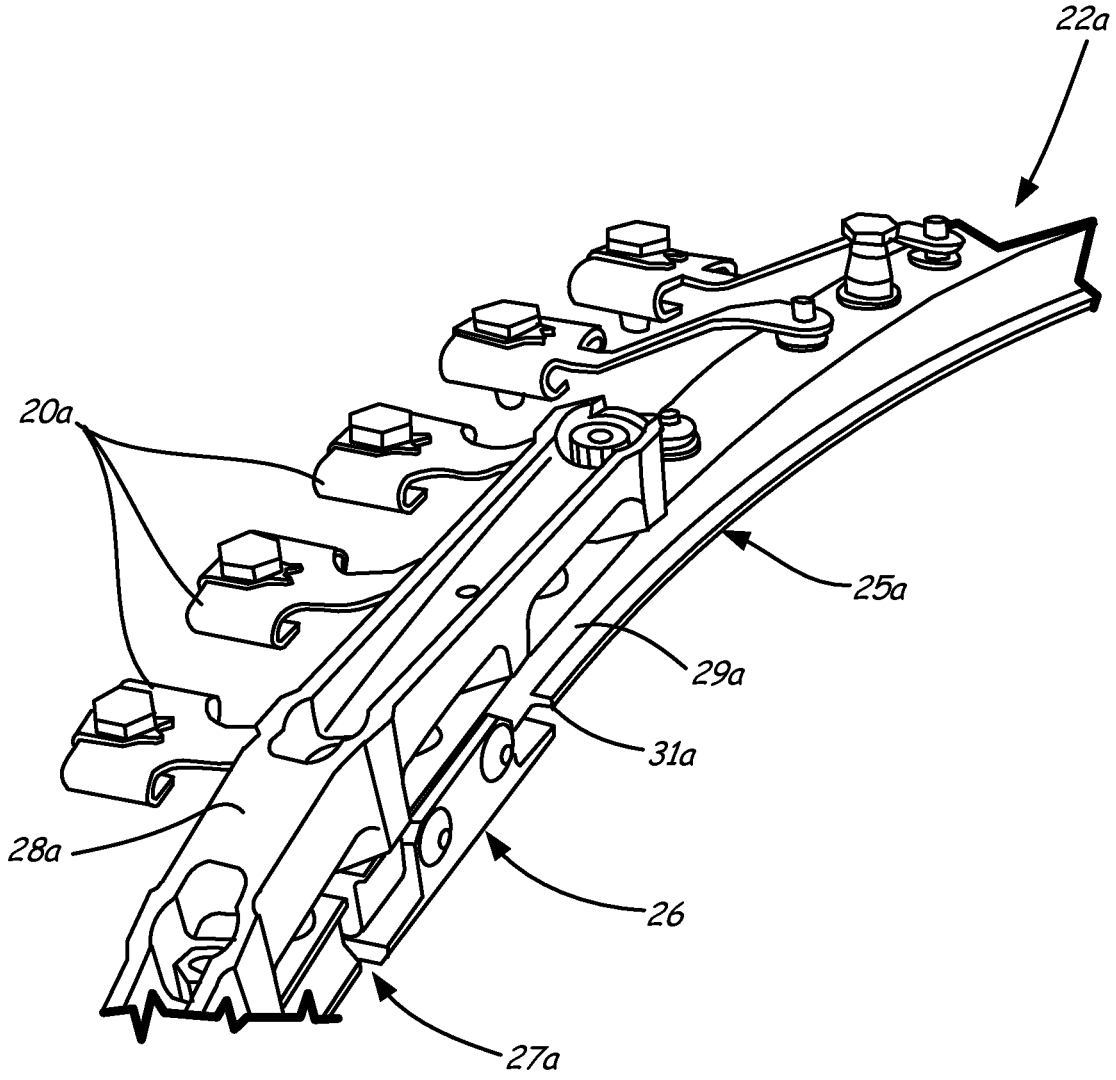
FIG. 3 is a perspective view of a portion of the synchronizing ring and the surge bumper assembly of FIG. 2.

FIG. 2 is an aft view of synchronizing ring assembly 22*a* from along engine centerline axis $C_L$. FIG. 3 is a perspective view of a portion of synchronizing ring assembly 22*a* and vane arms 20*a*. In FIG. 2, components such as engine case 18 and VGVs 12*a*-12*d* are not shown. In addition to bumpers 24*a*, synchronizing ring assembly 22*a* includes a surge bumper assembly 26 and splice brackets 28*a* and 28*b*. FIG. 3 illustrates vane arms 20*a*, a ring section 25*a*, surge bumper 26, a gap 27*a*, a splice bracket 28*a*, a first side surface 29*a* and an inner radial surface 31*a*.

As shown in FIG. 2, synchronizing ring assembly 22*a* extends generally circumferentially around engine centerline axis $C_L$. Bumpers 24*a* are disposed along inner radial surface 31*a* (FIG. 3) of synchronizing ring assembly 22*a* at various locations. In the embodiment shown, synchronizing ring assembly 22*a* is split in half with two arcuate ring sections 25*a* and 25*b*. These ring sections 25*a* and 25*b* are disposed adjacent one another spaced at gaps 27*a* and 27*b*. Surge bumper assembly 26 is connected via generally axially extending rivets (with respect to engine centerline axis $C_L$) to first side surface 29*a* (FIG. 3) of synchronizing ring assembly 22*a* and extends to be positioned adjacent inner radial surface 31*a* (FIG. 3) of synchronizing ring assembly 22*a* near casing 18 (FIG. 1). In the embodiment shown, surge bumper assembly 26 is disposed on ring section 25*a* adjacent gap 27*a*. Splice brackets 28*a* and 28*b* are disposed radially outward of ring sections 25*a* and 25*b* and connect ring sections 25*a* and 25*b* together. Although only one surge bumper assembly 26 is illustrated in FIGS. 2 and 3, in other embodiments multiple surge bumper assemblies can be utilized.

Figure 4:
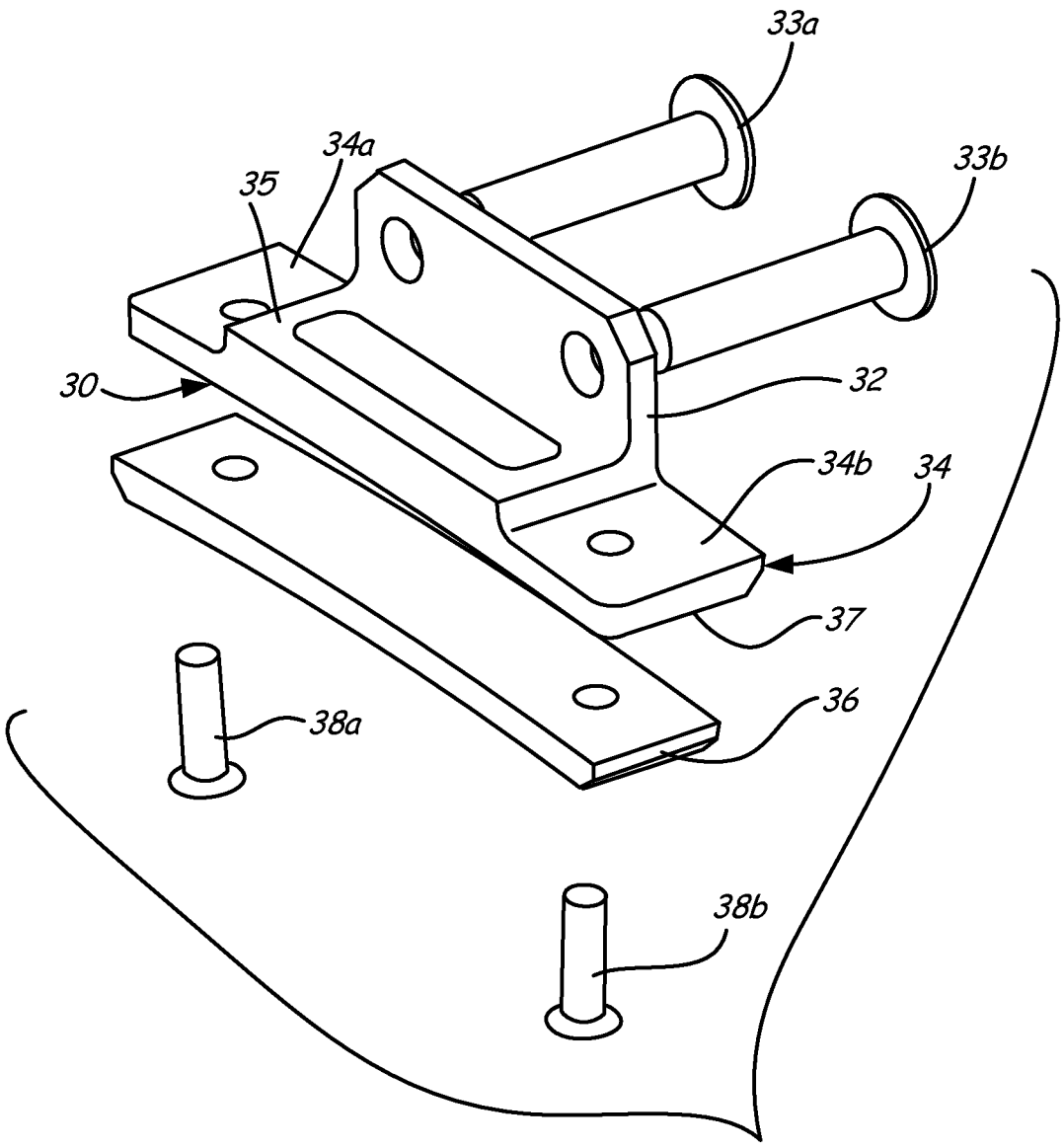
FIG. 4 is an exploded view of surge bumper assembly of FIG. 3.

FIG. 4 shows an exploded view of surge bumper assembly 26. Surge bumper assembly 26 includes bracket 30, rivets 33*a* and 33*b*, pad 36, and rivets 38*a* and 38*b*. Bracket 30 includes mounting portion 32, main body 35, flanges 34*a* and 34*b* and a pad seating portion 34.

Fasteners such as rivets 33*a* and 33*b* are adapted to be received in mounting portion 32 of bracket 30. Main body 35 and flanges 34*a* and 34*b* together form pad seating portion 34 that extends generally perpendicularly from mounting portion 32. Flanges 34*a* and 34*b* are arranged on either end of main body 35 and are adapted to receive rivets 38*a* and 38*b*. Pad 36 is comprised of a composite material and is adapted to mount to an inner radial surface 37 of bracket 30 and is connected thereto by fasteners such as rivets 38*a* and 38*b*. In one embodiment, pad 36 is comprised of a reinforced polyimide resin such as CP-0301 manufactured by DuPont Corporation of Wilmington, Del.

Rivets 33*a* and 33*b* are adapted to extend generally axially with respect to engine centerline axis $C_L$ (FIGS. 1 and 2). In particular, mounting portion 32 of bracket 30 is adapted to receive rivets 33*a* and 33*b*, which additionally extend into first side surface 29*a* of ring section 25*a* (FIG. 3). Main body 35 and flanges 34 extend from mounting portion 32 and are adapted to be received in a recess of ring section 25*a* (FIG. 3). Rivets 38*a* and 38*b* are adapted to extend generally radially with respect to engine centerline axis $C_L$ (FIGS. 1 and 2) to connect pad 36 to bracket 30. In one embodiment, pad 36 extends radially from bracket 30 to be flush with or protrude from inner radial surface 31*a* (FIG. 3) of synchronizing ring assembly 22*a* (FIGS. 2 and 3). During certain operation conditions (e.g., surge), the surge bumper assembly 26 contacts engine case 18 (FIG. 1) to minimize excessive radial deflection (chording) of the synchronizing ring assembly 22*a* (FIGS. 2 and 3).

Figure 5A:
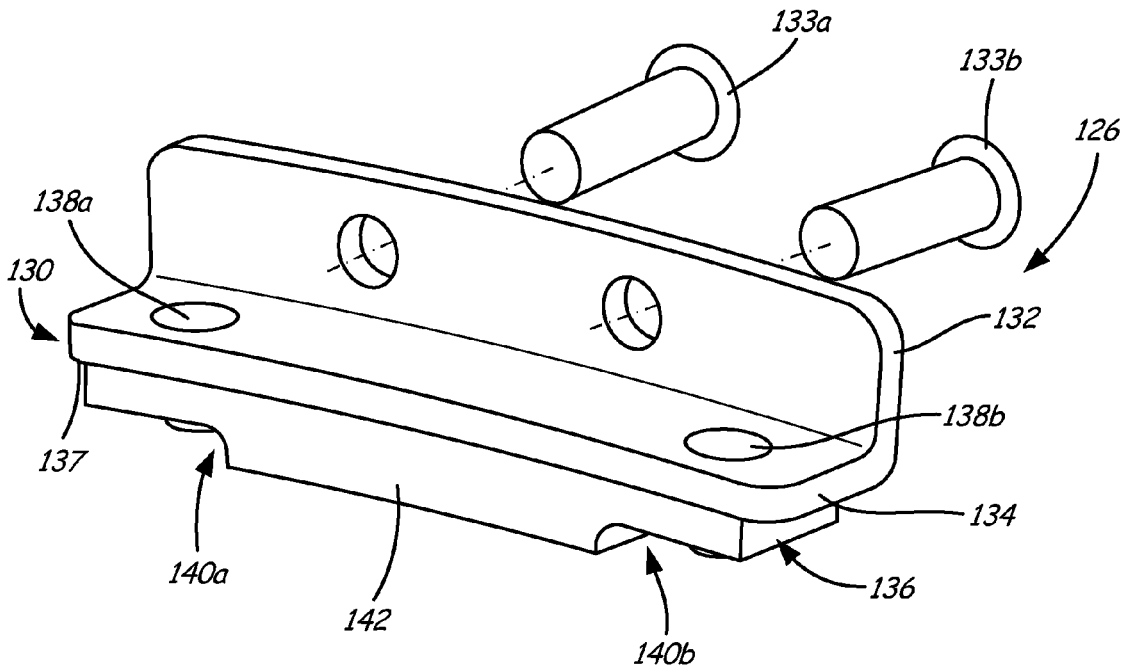
FIG. 5A is a perspective view of a second embodiment of a surge bumper assembly.
Figure 5B:
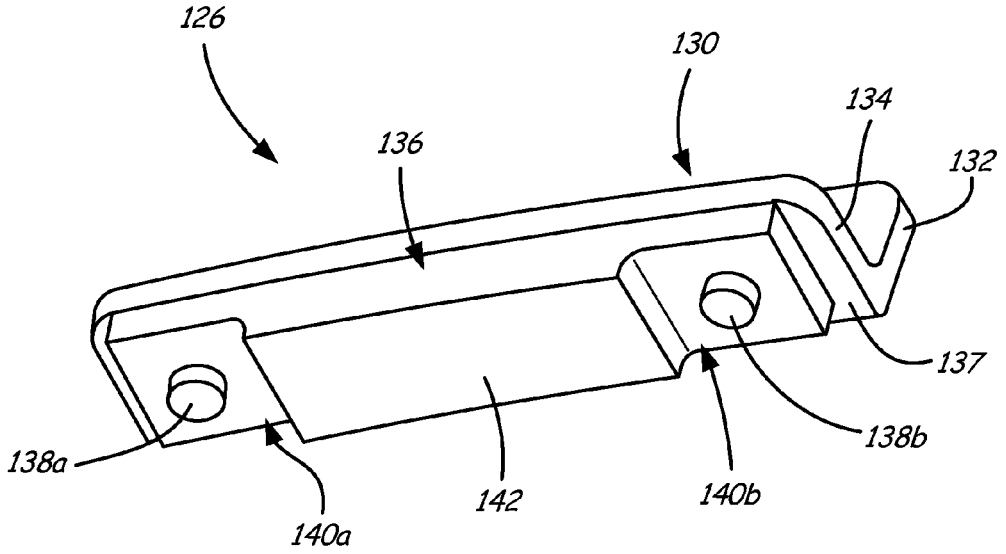
FIG. 5B is a perspective view of the surge bumper assembly of FIG. 5A.

FIGS. 5A and 5B show views of a second embodiment of surge bumper assembly 126. Surge bumper assembly 126 includes bracket 130, rivets 133*a* and 133*b*, pad 136, and rivets 138*a* and 138*b*. Bracket 130 includes a mounting portion 132 and a pad seating portion 134.

Fasteners such as rivets 133*a* and 133*b* are adapted to be received in mounting portion 132 of bracket 130. Pad seating portion 134 extends generally perpendicularly from mounting portion 132 and is adapted to receive rivets 138*a* and 138*b*. Pad 136 is adapted to mount to an inner radial surface 137 of bracket 130 and is connected thereto by fasteners such as rivets 138*a* and 138*b*. In the embodiment shown in FIGS. 5A and 5B, pad 136 includes portions 140*a* and 140*b* that are thinner than main body 142.

Rivets 133*a* and 133*b* are adapted to extend generally axially with respect to engine centerline axis $C_L$ (FIGS. 1 and 2). In particular, mounting portion 132 of bracket 130 is adapted to receive rivets 133*a* and 133*b*, which additionally extend into first side surface 29*a* of ring section 25*a* (FIG. 3).). Rivets 138*a* and 138*b* are adapted to extend generally radially with respect to engine centerline axis $C_L$ (FIGS. 1 and 2) to connect pad 136 to bracket 130. Pad seating portion 134 extends from mounting portion 132 and is adapted to be received in a recess of ring section 125*a* (FIG. 3). In one embodiment, pad 136 extends radially from bracket 130 to be flush with or protrude from inner radial surface 31*a* (FIG. 3) of synchronizing ring assembly 22*a* (FIGS. 2 and 3). During certain operation conditions (e.g., surge), the surge bumper assembly 126 contacts engine case 18 (FIG. 1) to minimize excessive radial deflection (chording) of the synchronizing ring assembly 22*a* (FIGS. 2 and 3).

Figure 6:
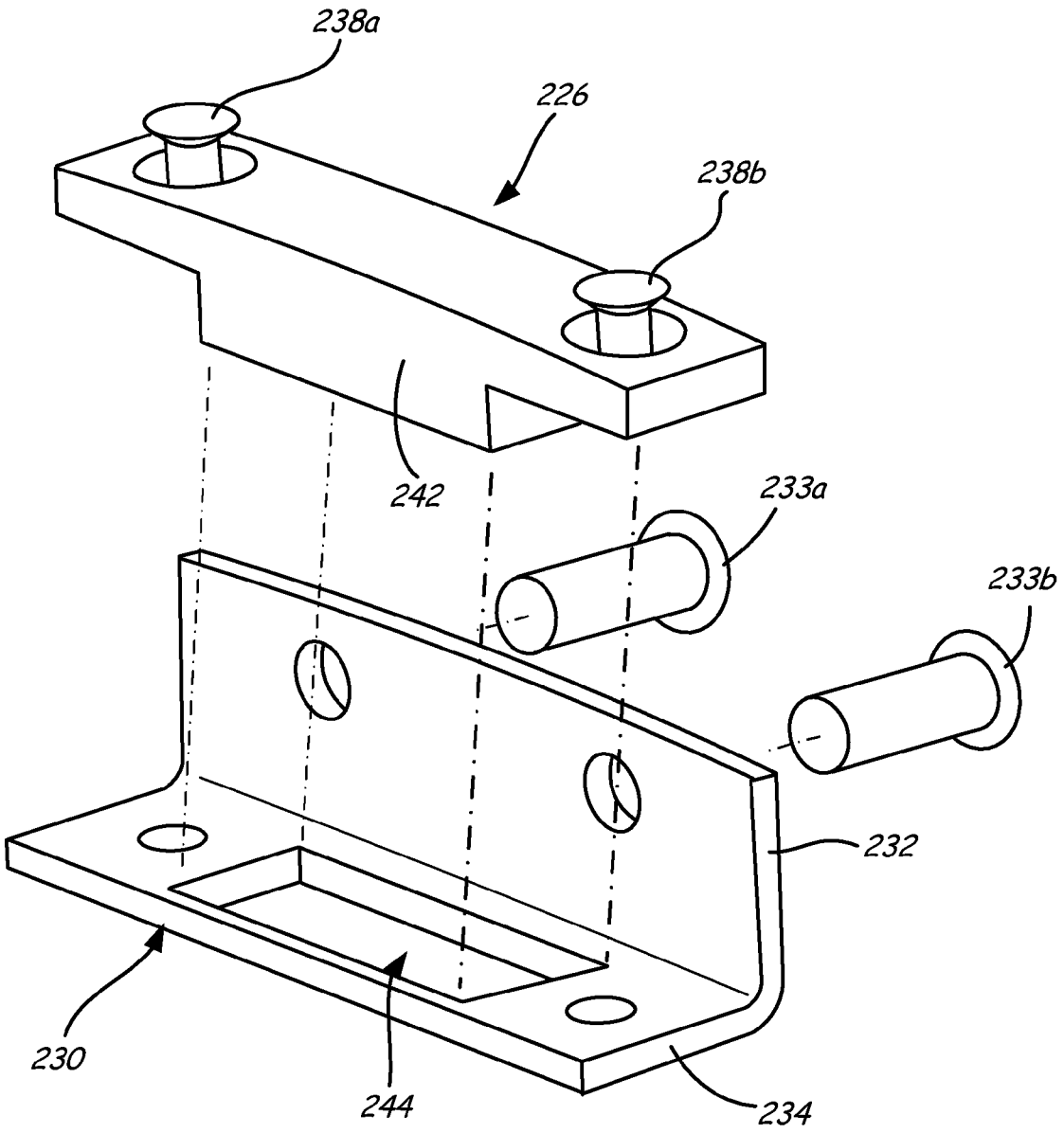
FIG. 6 is an exploded view of a third embodiment of a surge bumper assembly.

FIG. 6 shows an exploded view of yet another embodiment of a surge bumper assembly 226. Surge bumper assembly 226 includes bracket 230, rivets 233*a* and 233*b*, pad 236, and rivets 238*a* and 238*b*. Bracket 230 includes mounting portion 232 and pad seating portion 234. Pad 236 includes a main body 242. Pad seating portion 234 includes a hole 244.

Fasteners such as rivets 233*a* and 233*b* are adapted to be received in mounting portion 232 of bracket 230. Pad seating portion 234 extends generally perpendicularly from mounting portion 232. Pad seating portion 234 is adapted to receive rivets 238*a* and 238*b*. Pad 236 is adapted to mount flush to the pad seating portion 234 of bracket 230 and is connected thereto by fasteners such as rivets 238*a* and 238*b*. Pad 236 is adapted to mount flush to the inner radial surface 31*a* (FIG. 3) of synchronizing ring assembly 22*a* (FIGS. 2 and 3). In the embodiment shown in FIG. 6, pad 236 includes thickened main body 242 that is adapted to extend through hole 244 in bracket 240.

Rivets 233*a* and 233*b* are adapted to extend generally axially with respect to engine centerline axis $C_L$ (FIGS. 1 and 2). In particular, mounting portion 232 of bracket 230 is adapted to receive rivets 233*a* and 233*b*, which additionally extend into first side surface 29*a* of ring section 25*a* (FIG. 3). Pad seating portion 234 extends from mounting portion 232 and is adapted to be received in a recess of ring section 25*a* (FIG. 3). Rivets 238*a* and 328*b* are adapted to extend generally radially with respect to engine centerline axis $C_L$ (FIGS. 1 and 2) to connect pad 236 to bracket 230. In one embodiment, pad 236 extends radially from bracket 230 to be flush with or protrude from inner radial surface 31*a* (FIG. 3) of synchronizing ring assembly 22*a* (FIGS. 2 and 3). During certain operation conditions (e.g., surge), the surge bumper assembly 226 contacts engine case 18 (FIG. 1) to minimize excessive radial deflection (chording) of the synchronizing ring assembly 22*a* (FIGS. 2 and 3).

The present application discloses a surge bumper assembly that is part of a synchronizing ring assembly for a gas turbine engine. The surge bumper assembly includes a bracket that is riveted or otherwise connected to the synchronizing ring adjacent a split in the synchronizing ring. A composite pad is riveted or otherwise connected to the bracket so as to be disposed between the bracket and a case of the gas turbine engine.

During certain operation conditions (e.g., surge), the surge bumper assembly minimizes excessive radial deflection (chording) of the synchronizing ring assembly. This allows the synchronizing ring assembly to achieve more precise alignment and positioning of variable vanes as well as reducing stresses on the synchronizing ring assembly. The compact design of the surge bumper assembly allows it to be disposed in locations where other conventional bumpers are unable to fit. Additionally, the surge bumper assembly provides for a simplified easily installable design relative to conventional bumpers.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

In a further embodiment of any of the foregoing embodiments, the assembly and/or gas turbine engine may additionally or alternatively include the pad is mounted on at least one of an inner radial surface or outer radial surface of the bracket.

In a further embodiment of any of the foregoing embodiments, the assembly and/or gas turbine engine may additionally or alternatively include the pad is mounted to an outer radial surface of the bracket, and wherein a portion of pad extends through a hole in the bracket.

In a further embodiment of any of the foregoing embodiments, the assembly and/or gas turbine engine may additionally or alternatively include the first rivet comprises two rivets that extend through opposing ends of the pad from one another.

In a further embodiment of any of the foregoing embodiments, the assembly and/or gas turbine engine may additionally or alternatively include the bracket includes a mounting portion and a pad seating portion, and wherein the mounting portion extends generally perpendicularly with respect to the pad seating portion.

In a further embodiment of any of the foregoing embodiments, the assembly and/or gas turbine engine may additionally or alternatively include a synchronizing ring assembly, and wherein the mounting portion is adapted to interface and mount to a side surface of the synchronizing ring assembly.

In a further embodiment of any of the foregoing embodiments, the assembly and/or gas turbine engine may additionally or alternatively include a second rivet that is disposed generally perpendicular to the first rivet, wherein the second rivet extends through the mounting portion of the bracket to connect the bracket to the synchronizing ring.

In a further embodiment of any of the foregoing embodiments, the assembly and/or gas turbine engine may additionally or alternatively include the bumper assembly comprises a surge bumper assembly.

In a further embodiment of any of the foregoing embodiments, the assembly and/or gas turbine engine may additionally or alternatively include a pad connected to the bracket.

In a further embodiment of any of the foregoing embodiments, the assembly and/or gas turbine engine may additionally or alternatively include the pad is mounted on at least one of an inner radial surface or outer radial surface of the bracket.

In a further embodiment of any of the foregoing embodiments, the assembly and/or gas turbine engine may additionally or alternatively include wherein the pad is connected to the bracket by a first rivet.

In a further embodiment of any of the foregoing embodiments, the assembly and/or gas turbine engine may additionally or alternatively include a second rivet that is disposed generally perpendicularly to the first rivet, wherein the second rivet extends through a mounting portion of the bracket to connect the bracket to the synchronizing ring and the first rivet connects the pad to a pad seating portion of the bracket.

In a further embodiment of any of the foregoing embodiments, the assembly and/or gas turbine engine may additionally or alternatively include the bracket includes a pad seating portion and a mounting portion, and wherein the pad seating portion receives the pad thereon and extends generally perpendicularly to the mounting portion.

In a further embodiment of any of the foregoing embodiments, the assembly and/or gas turbine engine may additionally or alternatively include the pad is mounted on at least one of an inner radial surface or outer radial surface of the bracket.

In a further embodiment of any of the foregoing embodiments, the assembly and/or gas turbine engine may additionally or alternatively include a surge bumper assembly with a bracket and a pad connected to the bracket, the pad is connected to the bracket by a first rivet that extends generally radially with respect to a centerline axis of the gas turbine engine. In a further embodiment of any of the foregoing embodiments, the assembly and/or gas turbine engine may additionally or alternatively include the surge bumper assembly is connected to the first side surface of the synchronizing ring assembly by a second rivet that extends generally axially with respect to a centerline axis of the gas turbine engine.

In a further embodiment of any of the foregoing embodiments, the assembly and/or gas turbine engine may additionally or alternatively include the surge bumper assembly comprises a split rings, and wherein the surge bumper assembly is disposed adjacent a gap at an end of one of the ring sections.

The invention claimed is:

1. A bumper assembly comprising:

a bracket; and a pad connected to the bracket, wherein the pad is connected to the bracket by a first rivet and wherein the pad is mounted to an outer radial surface of the bracket, and wherein a thickened portion of the pad extends through a hole in the bracket.

2. The bumper assembly of claim 1, wherein the first rivet comprises two rivets that extend through opposing ends of the pad from one another.

3. The bumper assembly of claim 1, wherein the bracket includes a mounting portion and a pad seating portion, and wherein the mounting portion extends generally perpendicularly with respect to the pad seating portion.

4. The bumper assembly of claim 3, wherein the mounting portion of the bracket extends from a first side of the pad seating portion of the bracket and the pad is connected to a second side of the pad seating portion opposite the first side, such that the pad seating portion separates the mounting portion from the pad.

5. A bumper assembly comprising:

a bracket;

a pad connected to the bracket, wherein the pad is connected to the bracket by a first rivet; and a synchronizing ring assembly, wherein a mounting portion of the bracket is adapted to interface and mount to a side surface of the synchronizing ring assembly.

6. The bumper assembly of claim 5, further comprising a second rivet that is disposed generally perpendicular to the first rivet, wherein the second rivet extends through the mounting portion of the bracket to connect the bracket to the synchronizing ring.

7. A synchronizing ring assembly for a gas turbine engine, comprising:

a ring section; and a bumper assembly connected to a forward and/or aft side surface of the ring section and extending axially adjacent an inner radial surface of the ring, wherein the bumper assembly is disposed adjacent a gap at an end of the ring section.

8. The ring assembly of claim 7, wherein the bumper assembly comprises a surge bumper assembly.

9. The ring assembly of claim 7, further comprising a pad connected to the bracket.

10. The ring assembly of claim 9, wherein the pad is mounted on at least one of an inner radial surface or outer radial surface of the bracket.

11. The ring assembly of claim 10, wherein the pad is mounted to an outer radial surface of the bracket, and wherein a thickened portion of pad extends through a hole in the bracket.

12. The ring assembly of claim 9, wherein the pad is connected to the bracket by a first rivet.

13. The ring assembly of claim 12, further comprising a second rivet that is disposed generally perpendicularly to the first rivet, wherein the second rivet extends through a mounting portion of the bracket to connect the bracket to the ring section and the first rivet connects the pad to a pad seating portion of the bracket.

14. The ring assembly of claim 9, wherein the bracket includes a pad seating portion and a mounting portion, and wherein the pad seating portion receives the pad thereon and extends generally perpendicularly to the mounting portion.

15. The ring assembly of claim 9, wherein the pad has a variable thickness along a length thereof.

16. A gas turbine engine comprising:

an engine case;

a section, selected from the group consisting of a compressor and a turbine, having at least a first stage of variable guide vanes circumferentially spaced radially inward of the engine case;

a synchronizing ring assembly comprising split rings and being disposed about the engine case and connected to the first stage of variable guide vanes; and a surge bumper assembly connected to a first side surface of the synchronizing ring assembly and extending axially adjacent of an inner radial surface of the synchronizing ring assembly, wherein the surge bumper assembly is disposed adjacent a gap at an end of one of the ring sections.

17. The gas turbine engine of claim 16, wherein the surge bumper assembly comprises:

a bracket; and a pad connected to the bracket, wherein the pad is connected to the bracket by a first rivet that extends generally radially with respect to a centerline axis of the gas turbine engine.

18. The gas turbine engine of claim 17 and wherein the surge bumper assembly is connected to the first side surface of the synchronizing ring assembly by a second rivet that extends generally axially with respect to a centerline axis of the gas turbine engine.

* * * * *